US005619104A

United States Patent [19]

Eunghwa

[11] Patent Number: 5,619,104

[45] Date of Patent: Apr. 8, 1997

[54] MULTIPLIER THAT MULTIPLIES THE OUTPUT VOLTAGE FROM THE CONTROL CIRCUIT WITH THE VOLTAGE FROM THE BOOST CIRCUIT

[75] Inventor: Lee Eunghwa, Anyang, Rep. of Korea

[73] Assignee: Samsung Electronics Co., Ltd., Suwon, Rep. of Korea

[21] Appl. No.: 319,513

[22] Filed: Oct. 7, 1994

[51] Int. Cl.[6] ..... H05B 37/00

[52] U.S. Cl. ..... 315/159; 315/DIG. 7; 315/209 R; 315/225; 315/307

[58] Field of Search ..... 315/247, DIG. 7, 315/209 R, 219, 225, 159, 291, 307

[56] References Cited

U.S. PATENT DOCUMENTS

| | | | |
|---|---|---|---|
| 2,967,981 | 1/1961 | Wise | 315/159 |
| 3,483,428 | 12/1969 | La Plante | 315/159 |
| 4,251,752 | 2/1981 | Stolz | 315/247 |
| 4,277,728 | 7/1981 | Stevens | 315/247 |
| 4,412,154 | 10/1983 | Klein | 315/225 |
| 4,523,131 | 6/1985 | Zansky | 315/225 |
| 4,998,046 | 3/1991 | Lester | 315/209 R |

FOREIGN PATENT DOCUMENTS

| | | | |
|---|---|---|---|
| 59053 | 9/1982 | European Pat. Off. | 315/247 |

*Primary Examiner*—Robert Pascal
*Assistant Examiner*—Michael B. Shingleton
*Attorney, Agent, or Firm*—Burns, Doane, Swecker & Mathis. L.L.P.

[57] ABSTRACT

An automatic illumination intensity control apparatus for a discharge lamp includes a chopper circuit for stepping up D.C. voltage obtained by rectifying commercial A.C. voltage, an invertor circuit for converting D.C. voltage output from the chopper circuit into an A.C. voltage with a higher frequency to drive the discharge lamp, a brightness level sensing portion for sensing the brightness level of the area to be illuminated, a brightness level setting portion for setting brightness level of the area to be illuminated, and a power cut-off portion for stopping the operation of the invertor circuit when the sensed brightness level is greater than the set brightness level. The control apparatus may further include an illumination intensity adjusting portion for varying voltage output from the chopper circuit in proportion to the difference between the set brightness and sensed brightness when the sensed brightness is less than the set brightness. The control apparatus may further include an overcurrent preventing portion for automatically stopping the operation of the invertor circuit when the current value flowing through the discharge lamp is greater than a reference current value.

2 Claims, 3 Drawing Sheets

MULTIPLIER THAT MULTIPLIES THE OUTPUT VOLTAGE FROM THE CONTROL CIRCUIT WITH THE VOLTAGE FROM THE BOOST CIRCUIT

BACKGROUND OF THE INVENTION

1. Field of the Invention

The present invention is related to an automatic illumination intensity control apparatus for a discharge lamp such as a fluorescent lamp, and particularly to an automatic illumination intensity control apparatus for a discharge lamp for automatically maintaining the brightness of the area to be illuminated at an intensity set by the user, and preventing any overcurrent from flowing through the discharge lamp.

2. Description of the Prior Art

Recently, various improvements are have been achieved in the art of illumination intensity control which can vary the illumination intensity of a discharge lamp by an inverter-type drive circuit.

FIG. 1 is a block diagram schematically illustrating a conventional discharge lamp ballast with an illumination intensity control.

Referring to FIG. 1, the discharge lamp ballast includes a discharge lamp 22 such as a fluorescent lamp, a control knob 10 for setting a duty cycle which allows the illumination intensity control of the discharge lamp 22, an oscillator 12 for generating an oscillating signal with a predetermined frequency, a frequency convertor 14 for converting the frequency of the oscillating signal into different frequency, a variable pulse width modulator 16 for varying the on-off duty cycle of the signal output from the frequency converter 14 according to the on-off duty cycle set by the control knob 10, a switching element 18 turned on or off by the modulating signal from the variable pulse width modulator 16, and a first and second transformer 20 obtaining induced voltage according to the turning on-off of the switching element 18.

In the afore-mentioned discharge lamp ballast the intensity of illumination is controlled by varying the electrical power delivered to the discharge lamp 22 according to the on-off duty cycle set by the control knob 10. Further explanation of the prior art will be omitted in this specification because the details are disclosed in U.S. Pat. No. 4,998,046.

However, the conventional art has a problem in that an additional wire member should be undesirably provided in a wire transmission, and manufacturing cost becomes expensive in a wireless transmission, that is, a remote control.

Moreover, the output of the discharge lamp is fixed to the level set by the user without any consideration to the natural brightness of the area that is to be illuminated.

Furthermore, the frequency band used overlaps with that of a general remote control, thereby causing other electric appliances to malfunction.

SUMMARY OF THE INVENTION

It is an object of the present invention to provide an automatic illumination intensity control apparatus for a discharge lamp which can vary the illumination intensity of the lamp to consistently maintain the brightness in the area to be illuminated to the level set by a user, thereby protecting the user's eyesight and decreasing the electric power consumed in the discharge lamp.

It is another object of the present invention to provide an automatic illumination intensity control apparatus for a discharge lamp capable of preventing overcurrent from flowing through the discharge lamp, thereby protecting the apparatus.

It is still another object of the present invention to provide an automatic illumination intensity control apparatus for a discharge lamp which can lengthen the life expectancy of the discharge lamp and restrain the generation of noise signals affecting the operation of other appliances by correcting the power factor of the A.C. power supplied to the discharge lamp.

To achieve the afore-mentioned objects, the automatic illumination intensity control apparatus for a discharge lamp largely comprises a chopper circuit for stepping up D.C. voltage obtainable by rectifying commercial A.C. voltage; an inverter circuit for converting D.C. voltage output from the chopper circuit into A.C. voltage with a predetermined frequency to drive the discharge lamp; a means for setting brightness of the area to be illuminated; a means for sensing the brightness of the area to be illuminated; and a means for stopping the operation of the inverter circuit when the sensed brightness is greater than the set brightness.

As a result, the discharge lamp consumes no electric power when natural brightness in the area to be .illuminated is greater than that set by the user.

The control apparatus may further comprise a means for varying the voltage output from the chopper circuit in proportion to the difference between the set brightness and the sensed brightness when the sensed brightness is less than the set brightness, thereby automatically controlling the electric power consumed in the discharge lamp based on the natural brightness.

In accordance with further teaching of the present invention, the apparatus may further comprise a means for detecting the value of current flowing through the discharge lamp, and a means for automatically stopping the operation of the inverter circuit when the detected current value is more than a reference current value, thereby preventing any damage to the discharge lamp.

BRIEF DESCRIPTION OF THE DRAWINGS

The present invention will become more readily apparent from the following description in connection with the accompanying drawings wherein.

DETAILED DESCRIPTION OF THE PREFERRED EMBODIMENTS

For a better understanding of the present invention, together with other and further objects, advantages and capabilities thereof, reference is made to the following disclosure and appended claims in connection with the above-described drawings.

Figure 1:
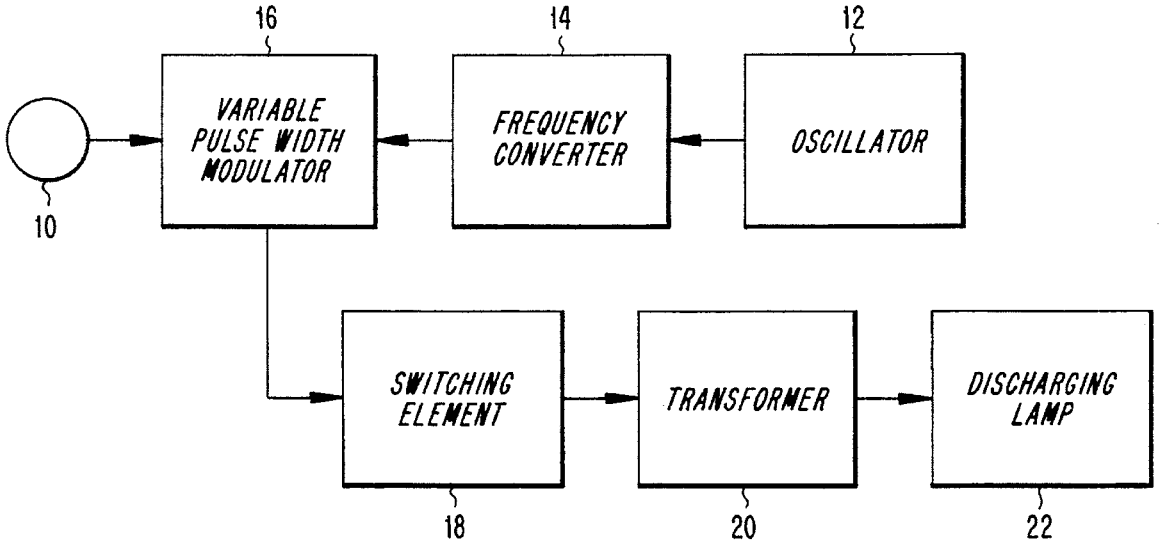
FIG. 1 (PRIOR ART)
FIG. 1 is a block diagram schematically illustrating a conventional discharge lamp ballast with an illumination intensity control.
Figure 2:
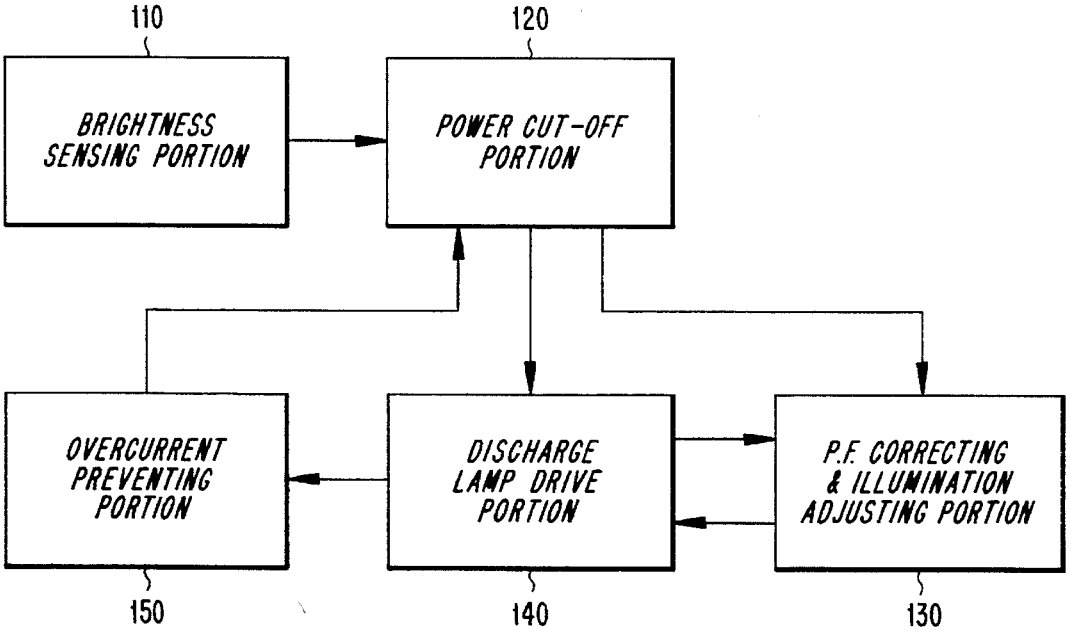
FIG. 2 is a schematic diagram of an automatic illumination intensity control apparatus for a discharge lamp according to the present invention.

Referring to FIG. 2, the illumination intensity control apparatus comprises a discharge lamp drive portion 140 for lighting a discharge lamp after converting commercial A.C. voltage into another A.C. voltage with a higher frequency, a brightness sensing portion 110 and power cut-off portion 120 for sensing the brightness of the area to be illuminated and cutting off the power supplied to the lamp when the sensed brightness is greater than the brightness set by the user, a power factor correcting and illumination intensity adjusting section 130 for making voltage and current applied to the discharge lamp be in phase and for varying the power supplied to the discharge lamp in proportion to the difference between the sensed brightness and the set brightness when the sensed brightness is less than the brightness set by the user, and an overcurrent preventing portion 150 for detecting the value of current flowing through the discharge lamp and for cutting off the power supplied to the discharge lamp when the detected current value is more than a reference current value.

Figure 3:
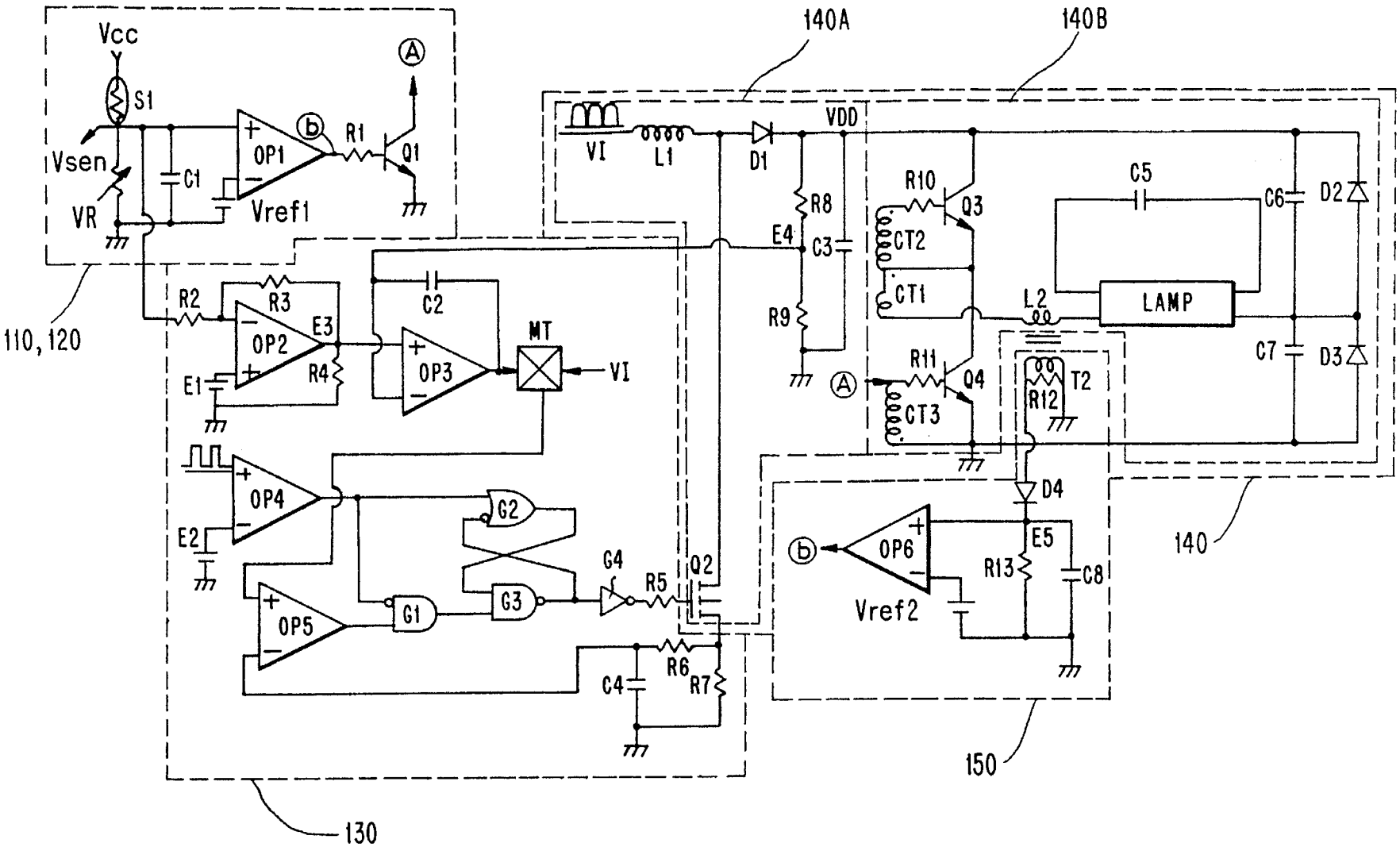
FIG. 3 is a concrete circuit diagram for the control apparatus shown in FIG. 2; and, FIG. 4 is a flow chart for explaining the operation of the control apparatus according to the present invention.

Referring to FIG. 3, the discharge lamp driving portion 140 may be roughly divided into two segments: one is a chopper circuit 140A for stepping up D.C. voltage obtained by rectifying commercial A.C. voltage, and the other is an inverter circuit 140B for converting D.C. voltage into another A.C. voltage with a higher frequency such as about 30 kHz, and for lighting a discharge lamp LAMP.

The chopper circuit 140A includes a choke coil L1, a diode D1, a field effect transistor Q2, voltage dividing resistors R8 and R9, and a capacitor C3.

The inverter circuit 140B is formed as a self-exciting half-bridge type, and includes a discharge lamp LAMP, a pair of switching transistors Q3 and Q4 coupled in series across the output terminals of the chopper circuit 140A, a coil CT2 coupled between the base and emitter of the transistor Q3 by way of a resistor R10, a coil CT1 coupled between the emitter of the transistor Q3 and a filament terminal of the discharge lamp LAMP via a coil L2, a coil CT3 coupled between the base and emitter of the transistor Q4 via a resistor R11, a capacitor C5 for lamp start-up, coupled between both filament terminals of the discharge lamp LAMP, a capacitor C6 and a diode D2 coupled in parallel between the collector of the transistor Q3 and the filament terminal of the discharge lamp LAMP, and a capacitor C7 and a diode D3 coupled in parallel between the filament terminal of the discharge lamp LAMP and ground.

The brightness sensing portion 110 and power cut-off portion 120 include a brightness sensor S1, a variable resistor VR connected in series with the brightness sensor S1, an operational amplifier OP1 for comparing the voltage across the variable resistor VR with a predetermined reference voltage Vref1, and a transistor Q1 with the base connected to the output terminal of the operational amplifier OP1 via a current limit resistor R1 and the collector connected to the resistor R11 of the chopper circuit 140B.

The power factor correcting and illumination intensity adjusting portion 130 includes an operational amplifier OP2 for amplifying and outputting the difference between the voltage Vsen representative of the brightness of the area to be illuminated and a predetermined reference voltage E1, an operational amplifier OP3 for comparing the output voltage E3 with the divided output voltage E4 of the chopper circuit 140A, a multiplier MT for multiplying voltage obtained by properly dividing the full-wave rectified input voltage Vi by the output voltage of the operational amplifier OP3, a resistor R7 for converting current flowing through the field effect transistor Q2 to corresponding voltage, an operational amplifier OP5 for comparing the output voltage of the multiplier MT with the voltage across the resistor R7, an operational amplifier OP4 for comparing an external pulse signal with a predetermined reference voltage E2, a latch circuit G1 to G4 for temporarily storing the output state of the operational amplifier OP5 and then turning the transistor Q2 on or off, and a resistor R5 for limiting the current flowing through the gate of the field effect transistor Q2. The reference characters R6 and C4 not set forth in the foregoing description respectively denote a resistor and capacitor for eliminating the leading edge current spike, and the reference character C2 denotes a capacitor for eliminating the ripple contained in the divided output voltage E4.

The power factor correcting and illumination intensity adjusting portion 130 may be preferably embodied by an integrated circuit, for example an IC which is manufactured by Samsung Electronics Co., Ltd. and identified as KA7514.

The overcurrent preventing portion 150 includes a coil T2 for current detection, a resistor R12 for converting the detected current to voltage, a circuit comprising a diode, resistor and capacitor D4, R13 and C8 for generating D.C. voltage E5 by rectifying and smoothing the voltage across the resistor R12, and an operational amplifier OP6 for stopping the operation of the inverter circuit 140B when D.C voltage E5 is higher than a reference voltage Vref2.

Hereinafter, the operation of the illumination intensity control apparatus for a discharge lamp according to the present invention will be described in detail.

Figure 4:
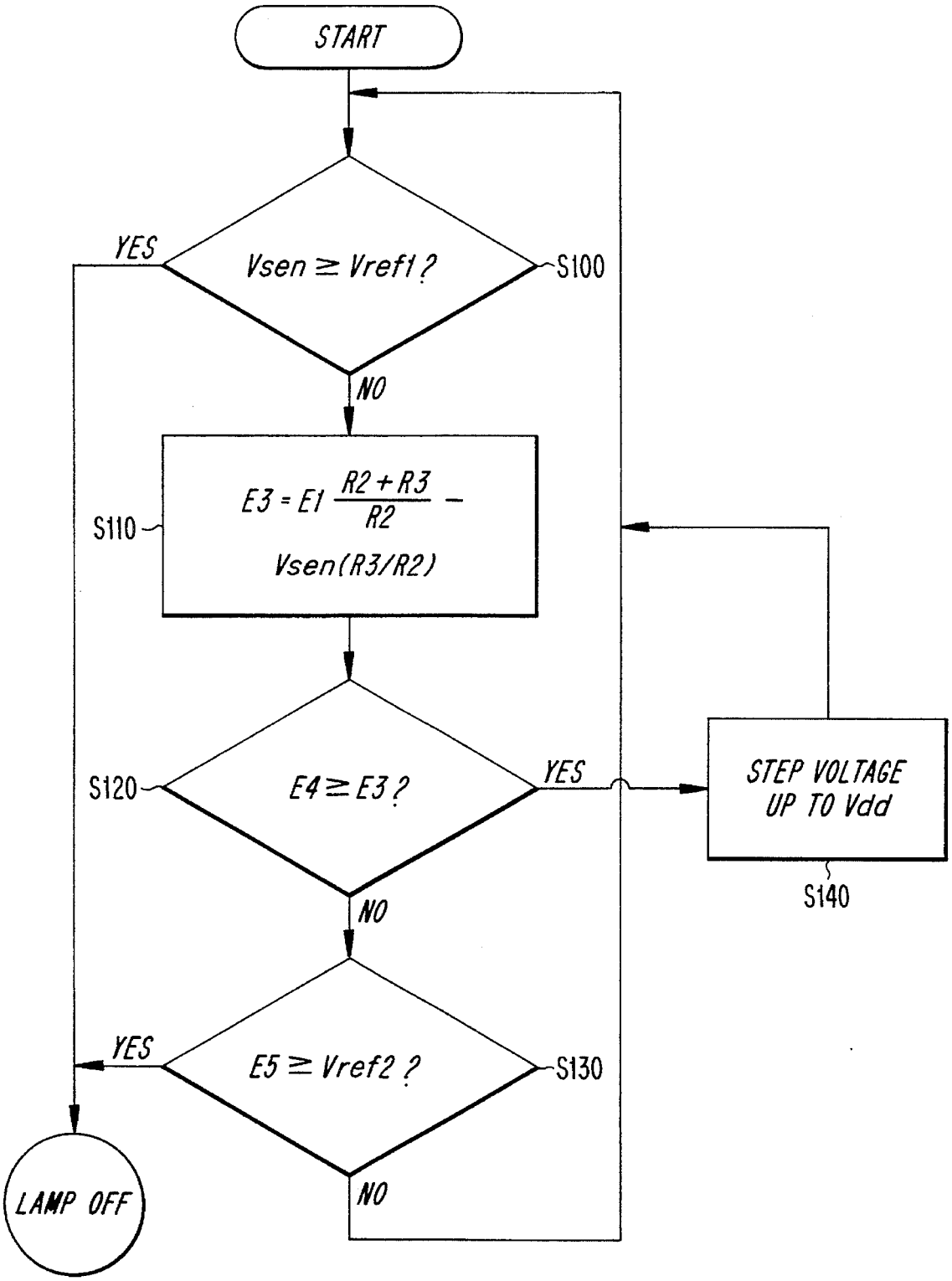

Referring to FIG. 4, if the user turns on the switch (not shown) delivering commercial A.C. power to the apparatus, the voltage Vi rectified through a diode bridge circuit (not shown) is delivered to the chopper circuit 140A. The chopper circuit 140A, then, generates voltage (Vdd) according to the on and off time periods of the transistor Q2, which is determined by the following formula.

$$Vdd=Vi\ (Ton+Toff)/Toff$$

That is, the coil L1 stores energy while the transistor Q2 is in on-state, and current flows through the inverter circuit 140B while the transistor Q2 is in off-state, thereby varying the average power supplied to the discharge lamp LAMP.

The inverter circuit 140B alternatively operates the transistors Q3 and Q4 by repeated energy exchanges between the coil L2 and capacitors C6 and C7, and drives the discharge lamp LAMP with A.C. voltage having the frequency of about 30 kHz generated by the operations of the transistors Q3 and Q4.

On the other hand, the user may precisely set a desired illumination intensity by adjusting the variable resistor VR.

The brightness sensor S1 may be embodied by a Cds element, whose resistance becomes less as the brightness becomes greater. Therefore, the greater the brightness, the higher the voltage Vsen across the variable resistor VR.

When the voltage Vsen is higher than the reference voltage Vref1, that is, the determination result in step S100 is "YES", the operational amplifier OP1 outputs a high level signal, thereby resulting in the decrease of the electric potential at point A. As a result, the transistor Q4 is turned off, thereby extinguishing the discharge lamp LAMP.

As set forth above, when the set brightness can be satisfied only by natural light, then the discharge lamp LAMP is extinguished, thereby lowering the power consumption.

When the voltage Vsen is lower than the reference voltage Vref1, that is, when the determination result in step S100 is "NO", then the operational amplifier OP1 outputs a low level signal, thereby allowing the transistors Q3 and Q4 to operate alternatively.

The operational amplifier OP2 amplifies the difference between the reference voltage E1 and the voltage Vsen with a proper coefficient in step S110, and the amplified difference voltage E3 is subsequently used in varying the voltage Vdd supplied to the inverter circuit 140B where the difference voltage E3 is determined by the following formula.

$$E3=E1\ ((R2+R3/R2)-Vsen\ (R3/R2)$$

The operational amplifier OP3 compares the difference voltage E3 with the voltage E4 obtained by properly dividing the output voltage Vdd of the chopper circuit 140B in step S120. When the difference voltage E3 is higher than the divided output voltage E4, that is, when the determination result in step S120 is "NO", then the operational amplifier OP3 outputs a high level signal thereby allowing the transistor Q2 to be turned on. As a result, the greater the brightness, the lower the difference voltage E3. Accordingly, the voltage Vdd decreases, thereby lowering the power supplied to the discharge lamp LAMP.

Hereinafter, the operation of the configuration for correcting the power factor in the electric power delivered to inverter circuit 140B will be described in detail.

The multiplier MT multiplies the voltage output from the operational amplifier OP3 by the voltage obtained by properly dividing the input voltage Vi and then delivers it to the non-inverted (+) input terminal of the operational amplifier OP5. The output of the multiplier MT iS used for limiting the current flowing through the coil L1. The voltage corresponding to the current flowing through the coil L1, that is, the voltage across the resistor R7 is delivered to the inverted (+) terminal of the operational amplifier OP5. When the voltage output from the multiplier MT is higher than the voltage across the resistor R7, the operational amplifier OP5 outputs a high level signal, which passes through the latch circuit G1 to G4, thereby allowing the transistor Q2 to be turned on.

On the other hand, while the pulse signal input to the non-inverted (+) terminal of the operational amplifier OP4 is in the low level state, the transistor Q2 is in on-state, thereby allowing the current flowing through coil L1 to increase gradually. When the current flowing through coil L1 reaches the magnitude represented by the voltage output from the multiplier MT, then the transistor Q2 is turned off. The latch circuit G1 to G4, then, makes the transistor Q2 be in the off-state until the current flowing through coil L1 becomes zero. By repeating the operations as set forth above, the current is in phase with the voltage, thereby correcting the power factor.

In the overcurrent preventing portion 150, the coil T2 detects the current flowing through the discharge lamp LAMP, the voltage conversion circuit R12, D4, R13 and C4 converts it to a corresponding voltage E5, and then delivers the converted voltage signal E5 to the non-inverted (+) terminal of the operational amplifier OP6. When the voltage E5 is higher than a predetermined reference voltage Vref2, that is, the determination result in step S130 is "YES", the operational amplifier OP6 lowers the electric potential to point A, thereby turning the transistor Q4 off. As a result, overcurrent can not flow into the discharge lamp LAMP.

I claim:

1. An automatic illumination intensity control apparatus for a discharge lamp, comprising:

a chopper circuit for stepping up D.C. voltage obtained by rectifying commercially supplied A.C. voltage;

an inverter circuit for converting D.C. voltage output from the chopper circuit into A.C. voltage with a higher frequency than a frequency of the commercially supplied A.C. voltage to drive said discharge lamp;

a sensor for sensing a brightness level of an area to be illuminated;

a variable resistor connected in series to the brightness sensor for setting a desired brightness level;

means for stopping operation of said inverter circuit if a voltage across said variable resistor exceeds a set reference value in order to turn off said discharge lamp when the sensed brightness level is greater than a set brightness level;

means for automatically controlling a voltage output from said chopper circuit in accordance with a result of a comparison of a difference between the voltage across the variable resistor and a set reference voltage with the voltage output from the chopper circuit in order to maintain the sensed brightness level at a constant level;

means for detecting a current flowing through said discharge lamp;

means for stopping the operation of said inverter circuit according to a result of converting the detected current into a D.C. voltage and comparing the converted voltage with a reference voltage;

a multiplier for multiplying the output voltage value from the automatic voltage control means by an input voltage value of said chopper circuit;

means for controlling the output current from the chopper circuit following the comparison of the voltage corresponding to a current flowing at an input terminal of said chopper circuit and the output voltage of the multiplier;

means for transferring the signal from the current control means to the chopper circuit according to an external signal by comparing the voltage value of an external pulse signal with a reference voltage value;

means for latching the output of the current control means according to the output of the transferring means and outputting the latched signal to the chopper circuit; and means for removing a leading edge current spike.

2. The automatic illumination intensity control apparatus for a discharge lamp as set forth in claim 1, wherein:

the automatic voltage control means comprises means for amplifying the difference between the voltage across the variable resistor and the set reference voltage; means for comparing the amplified voltage with a divided output voltage of the chopper circuit; and means for outputting a signal to control the output voltage of the chopper circuit, thereby automatically maintaining the brightness level of said discharge lamp at a constant level.

* * * * *